US008500309B2

(12) United States Patent
Chang

(10) Patent No.: US 8,500,309 B2
(45) Date of Patent: Aug. 6, 2013

(54) LED UNIT

(75) Inventor: Hsiu-Ping Chang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 74 days.

(21) Appl. No.: 13/277,237

(22) Filed: Oct. 20, 2011

(65) Prior Publication Data

US 2012/0106165 A1 May 3, 2012

(30) Foreign Application Priority Data

Nov. 3, 2010 (TW) ..... 99137734 A

(51) Int. Cl.
*F21V 5/04* (2006.01)

(52) U.S. Cl.
USPC ..... 362/311.02; 362/332; 362/335

(58) Field of Classification Search
USPC ..... 362/555, 336, 311.02, 337
See application file for complete search history.

(56) References Cited

U.S. PATENT DOCUMENTS

| | | | | |
|---|---|---|---|---|
| 7,182,481 | B2 * | 2/2007 | Shimura | 362/244 |
| 7,841,750 | B2 * | 11/2010 | Wilcox et al. | 362/334 |
| 8,215,814 | B2 * | 7/2012 | Marcoux | 362/555 |
| 8,246,212 | B2 * | 8/2012 | Schaefer et al. | 362/294 |
| 8,348,475 | B2 * | 1/2013 | Wilcox et al. | 362/332 |
| 2009/0135581 | A1 * | 5/2009 | Yano et al. | 362/84 |

* cited by examiner

*Primary Examiner* — Peggy A. Neils
(74) *Attorney, Agent, or Firm* — Altis Law Group, Inc.

(57) ABSTRACT

A lens comprises a base, the base comprising a bottom face facing a light emitting side of a light source, and a top face; a first member comprising a convex part curved outward from a first portion of the top face, and a first light emergent face formed on a top of the convex part; wherein light emitted from the first light emergent face illuminates areas far away from the lens; and a second member connecting to the first member on a second portion of the top face, the second member comprising a second light emergent face; wherein the second light emergent face is at an angle from the top face, the second light emergent face is located at a lower elevation than the first light emergent face in relation to the top face, and light emitted from the second light emergent face illuminates areas near the lens.

13 Claims, 2 Drawing Sheets

LED UNIT

BACKGROUND

1. Technical Field

The present disclosure relates to LED (light emitting diode) units, and more particularly, to an LED unit having a lens.

2. Description of Related Art

Light emitting diodes ("LEDs") are widely used as new types of light sources in various applications such as road lamps, traffic lamps, tunnel lamps, resident lamps and so on. A lens is often used with an LED for collimating the light beams generated from the LED in a predetermined pattern. In LED products designed to illuminate areas at a long distance, a convex lens may be used to converge the light beams emitted from the LED. However, in other applications, such as vehicle headlamps, the LED products need to be able to provide illuminations not only to the area far away from the LED, but also the area near the LED. LED products with the conventional convex lens may not meet such requirements.

What is needed, therefore, is an LED unit which can overcome the deficiencies as described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
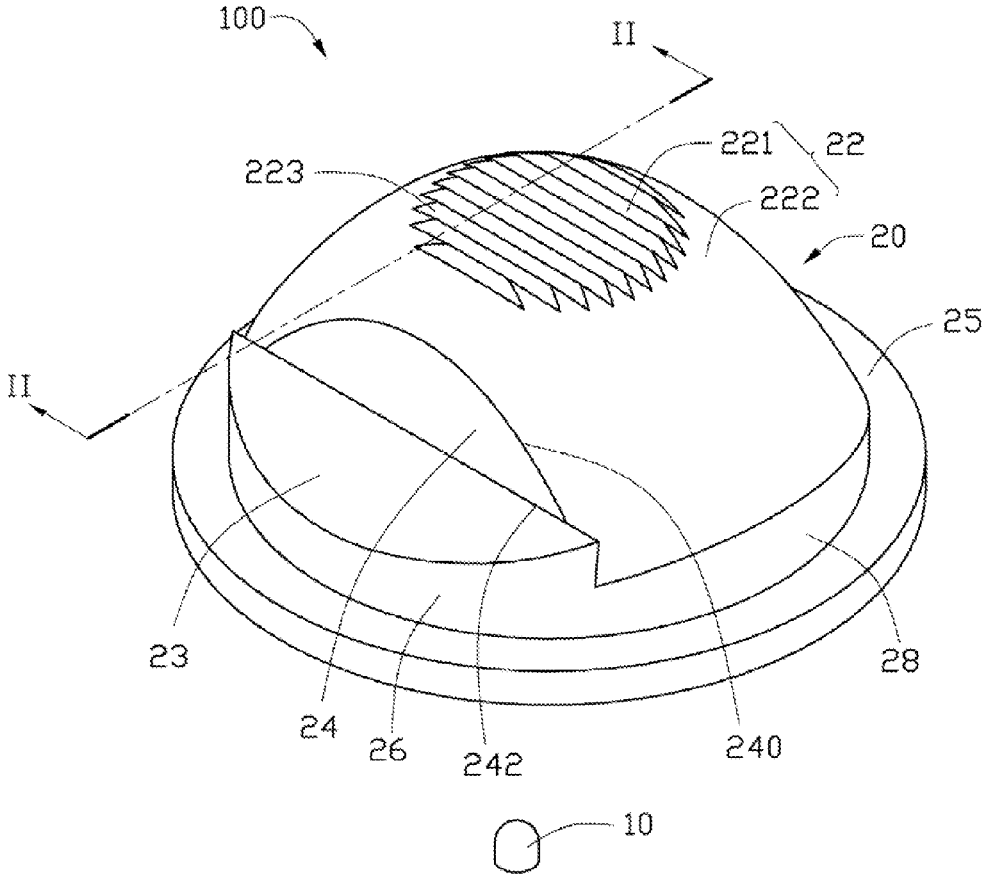
FIG. 1 is an isometric view of an LED unit in accordance with an embodiment of the present disclosure.

Referring to FIG. 1, an LED unit 100 in accordance with an embodiment of the present disclosure is shown. The LED unit 100 may be applied in vehicle headlamps or other suitable products where areas both near and far away from the LED unit 100 are required to be illuminated. The LED unit 100 includes a lens 20 on the light emitting side of an LED 10.

Figure 2:
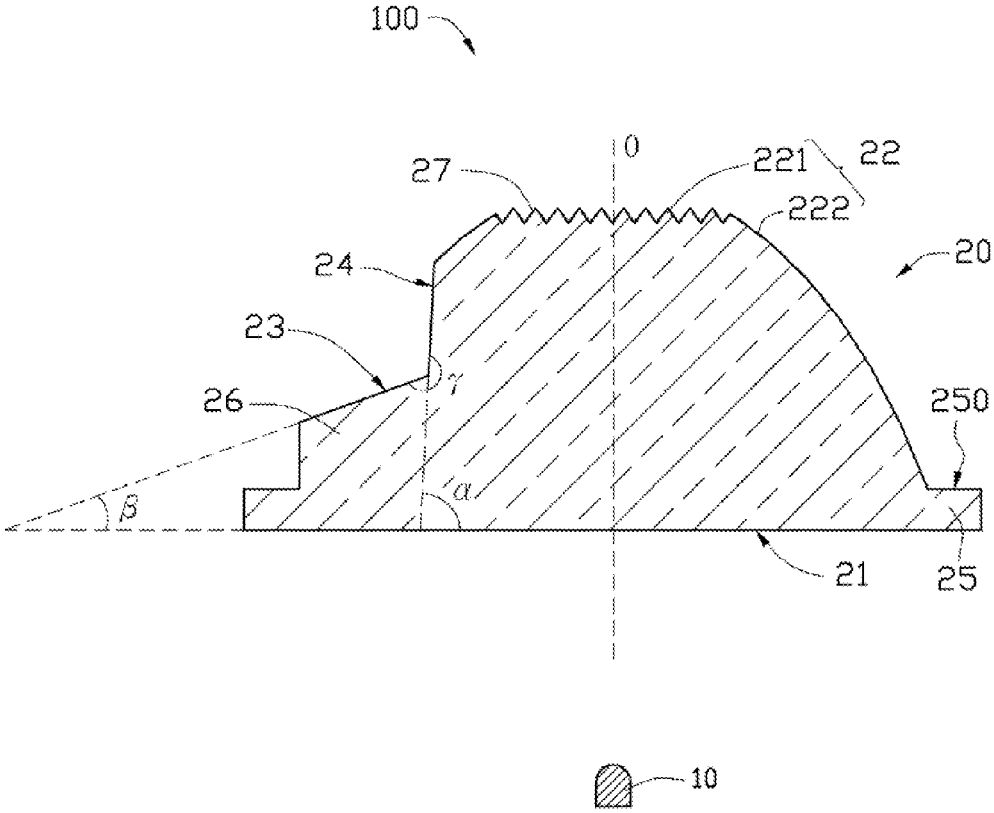
FIG. 2 is a cross sectional view of the LED unit taken along line II-II of FIG. 1.

In one embodiment, the LED 10 generates white light. However, other types of LEDs which generate different light colors may also be used in the LED unit 100. The lens 20 may be made of transparent materials such as epoxy, silicon, glass and so on. Referring to FIG. 2, the lens 20 may include a base 25, a first member 22, and a second member 26 formed on a top face 250 of the base 25. The base 25 may be substantially disk shaped. A bottom face of the base 25 may function as a light incident face 21 for transmitting light emitted from the LED 10 to the lens 20. The top face 250 and the bottom face of the base 25 may be planar and parallel to each other.

The first member 22 includes a convex part 222 and a sawtooth part 221 formed on the convex part 222. The convex part 222 curves outward from the top face 250 of the base 25. Circumferences of the convex part 222 have diameters gradually decreasing outward from the top face 250 to form a dome. The convex part 222 may converge incident light into narrow light beams to illuminate areas far away from the LED unit 100. Preferably, the convex part 222 has an optical axis O perpendicular to the light incident face 21 of the base 25. The LED 10 may be placed on the axis O and on the concave side of the lens 20 so that the light emitted by the LED 10 may be collimated by the convex part 222 to parallel light beams emitted out of the LED unit 100. The sawtooth part 221 may be formed on a top of the convex part 222. The sawtooth portion 221 may include a plurality of teeth 223 oriented upwardly. The sawtooth portion 221 may function as a first light emergent face 27 to diffuse the light beams from the light incident face 21 so that a wider area far away from the LED unit 100 may be illuminated. The convex portion 222 is intersected by a plane 24, which is connected to the second member 26. The plane 24 is bordered by a curved top edge 240 and a straight bottom edge 242. The plane 24 is at an angle $\alpha$ from the light incident face 21, wherein the angle $\alpha$ may be equal to or less than 90 degrees. The plane 24 may reflect some of the incident light towards the sawtooth part 221. As a result, a light-utilization efficiency of the lens 20 may be increased. A reflecting surface, which faces the lens 20, of the plane 24 may be formed by natural total reflection or coated with a high reflective material.

The second member 26 is connected with the first member 22. A continuous annular lateral face 28 comprises a sidewall of the first member 22 and a sidewall of the second member 26. The continuous annular lateral face 28 is connected to the top face 250 of the base 25. The continuous annular lateral face 28 has a largest height where the second member 26 and the first member 22 join. The second member 26 has an inclined top face intersects with the plane 24 at the straight bottom edge 242. The inclined top face of the second member 26 may function as a second light emergent face 23 to direct light from the LED 10 to illuminate areas near the LED unit 100. The second light emergent face 23 is at an angle $\beta$ from the light incident face 21, wherein the angle $\beta$ is smaller than the angle $\alpha$. An angle $\gamma$ between the second light emergent face 23 and the plane 24, measured facing the LED 10, is larger than 180 degrees.

When the LED unit 100 is applied to a headlamp of a vehicle, light emitted from the first light emergent face 27 may form a high beam to illuminate areas far away from the vehicle; whereas light emitted from the second light emergent face 23 may form a low beam to illuminate areas near the vehicle. As a result, areas in front of the vehicle may have a better visibility.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. A lens comprising:

a base, the base comprising a bottom face facing a light emitting side of a light source, and a top face;

a first member, the first member comprising a convex part curved outward from a first portion of the top face, and a first light emergent face formed on a top of the convex part; wherein light emitted from the first light emergent face illuminates areas far away from the lens; and a second member connecting to the first member on a second portion of the top face, the second member comprising a second light emergent face; wherein the second light emergent face is at an angle from the top face, the second light emergent face is located at a lower elevation than the first light emergent face in relation to the top face, and light emitted from the second light emergent face illuminates areas near the lens;

wherein the second light emergent face has a flat surface; and wherein a plane is formed between the second light emergent face and the first light emergent face.

2. The lens of claim 1, wherein the first member further comprises a sawtooth part formed on the top of the convex part, and the sawtooth part forms the first light emergent face.

3. The lens of claim 1, wherein the plane is connected to the second light emergent face at a straight bottom edge of the plane, and is separated from the first light emergent face.

4. The lens of claim 3, wherein the plane has a reflective surface, and has a curved top edge joined with the straight bottom edge.

5. The lens of claim 1, wherein an angle between the plane and the light incident face is larger than an angle between the second light emergent face and the light incident face.

6. The lens of claim 1, wherein an angle between the plane and the second light emergent face measured inside the lens is a reflex angle.

7. The lens of claim 1, wherein the light source is located on an optical axis of the convex part.

8. The lens of claim 3, wherein a continuous annular lateral face comprises a sidewall of the first member and a sidewall of the second member.

9. The lens of claim 8, wherein the continuous annular lateral face has a largest height measured from the top face to the straight bottom edge of the plane.

10. An LED unit comprising:

an LED; and a lens comprising a light incident face facing the LED, a second member, and a first member connected to the second member; wherein the first member comprises a first light emergent face through which light from the LED illuminates areas far away from the lens; the second member comprises a second light emergent face through which light from the LED illuminates areas near the lens, wherein the first light emergent face is separated from the second light emergent face;

wherein the second light emergent face is inclined relative to the light incident face, and is located at a lower elevation than the first light emergent face in relation to the light incident face; and wherein a plane is formed between the first light emergent face and the second light emergent face.

11. The LED unit of claim 10, wherein the first member comprises a convex part, and a sawtooth part formed on a top of the convex part; the sawtooth part forms the first light emergent face.

12. The LED unit of claim 10, wherein the plane is connected to the second light emergent face, and is separated from the first light emergent face.

13. The LED unit of claim 12, wherein an angle between the plane and the light incident face is larger than an angle between the second light emergent face and the light incident face.

* * * * *